US006340343B1

(12) United States Patent
Wild et al.

(10) Patent No.: US 6,340,343 B1
(45) Date of Patent: Jan. 22, 2002

(54) METHOD AND APPARATUS FOR PRODUCING FOIL BAGS

(75) Inventors: Hans-Peter Wild, Zug (CH); Eberhard Kraft, Neckarbischofsheim (DE)

(73) Assignee: Indag GmbH & Co. Betriebs-KG (DE)

( * ) Notice: Subject to any disclaimer, the term of this patent is extended or adjusted under 35 U.S.C. 154(b) by 0 days.

(21) Appl. No.: 09/317,000

(22) Filed: May 24, 1999

(30) Foreign Application Priority Data

Jun. 4, 1998 (DE) ..... 198 25 080

(51) Int. Cl.[7] ..... B31B 1/00

(52) U.S. Cl. ..... 493/10; 493/12; 493/194; 493/199

(58) Field of Search ..... 493/10, 11, 12, 493/189, 186, 194, 199, 205, 210, 227

(56) References Cited

U.S. PATENT DOCUMENTS

| | | | | |
|---|---|---|---|---|
| 4,270,908 A | * | 6/1981 | Lehmacher | |
| 4,610,649 A | * | 9/1986 | Friess | |
| 4,943,270 A | * | 7/1990 | Fleckenstein | |
| 5,000,725 A | * | 3/1991 | Bauknecht | 493/11 |
| 5,009,632 A | * | 4/1991 | Kruessel | |
| 5,447,486 A | * | 9/1995 | Anderson et al. | |
| 5,470,300 A | * | 11/1995 | Terranova | 493/11 |
| 5,782,731 A | * | 7/1998 | Kohn et al. | 493/11 |
| 5,807,222 A | * | 9/1998 | Totani | |
| 5,818,719 A | * | 10/1998 | Brandon et al. | 493/11 |
| 5,902,221 A | * | 5/1999 | Engels | |
| 5,978,499 A | * | 11/1999 | Tossel et al. | 493/12 |
| 6,149,565 A | * | 11/2000 | Meyer et al. | 493/11 |

FOREIGN PATENT DOCUMENTS

| | | | |
|---|---|---|---|
| AT | 368973 | | 11/1982 |
| DE | 2236524 | | 2/1974 |
| DE | 2442610 | A1 | 3/1976 |
| DE | 2534306 | A1 | 7/1976 |
| DE | 2513776 | A1 | 10/1976 |
| DE | 2700971 | A1 | 8/1977 |
| DE | 3425430 | A1 | 1/1986 |
| DE | 3631940 | A1 | 4/1987 |
| DE | 3727339 | A1 | 3/1989 |
| DE | 4114255 | A1 | 4/1992 |
| DE | 4225061 | A1 | 3/1993 |
| DE | 4446104 | A1 | 7/1996 |
| DE | 1950283 | A1 | 8/1996 |
| DE | 29521183 | U1 | 11/1996 |
| DE | 446104 | C1 | 4/1997 |
| JP | 59-148647 | | 8/1984 |
| JP | 06-170989 | A | 6/1994 |
| JP | 07-001617 | A | 1/1995 |
| WO | WO91/18797 | | 12/1991 |

* cited by examiner

*Primary Examiner*—Eugene Kim
(74) *Attorney, Agent, or Firm*—Seed Intellectual Property Law Group PLLC

(57) ABSTRACT

The present invention relates to a method and an apparatus for producing foil bags, wherein two foils are supplied for forming the side walls of the foil bag, wherein furthermore a bottom foil is supplied to have holes punched thereinto, said holes being spaced apart in the supply direction of the bottom foil at a distance corresponding to the width of a foil bag, wherein a measurement is carried out during the supply process for determining whether punched holes have been produced, and wherein subsequently the side foils and the bottom foil are placed one upon the other and connected to each other, and the foil layer sequence is then cut to form individual foil bags.

21 Claims, 4 Drawing Sheets

METHOD AND APPARATUS FOR PRODUCING FOIL BAGS

CROSS-REFERENCE TO RELATED APPLICATION

This application claims priority from German Patent Application No. 198 25 080.0, filed Jun. 4, 1998.

TECHNICAL FIELD

The present invention relates to a method of producing foil bags, wherein two foils are supplied to form the side walls of the foil bag and a bottom foil is supplied to form the bottom of the foil bag, and the foils are interconnected, and to an apparatus for carrying out the method.

BACKGROUND OF THE INVENTION

Foil bags are used for receiving filling material, such as beverages. Such foil bags consist e.g. of two side foils which are sealed to each other at two opposite edges. A bottom foil which in the folded-apart state constitutes a standing base and forms a space for the filling material between the side foils is sealed in between the corresponding third edges. After the filling operation the four side edges are sealed to one another.

For the manufacture of such foil bags the side foils and the bottom foil are unwound in one piece from corresponding supply rolls in automated processing lines, placed one upon the other in the correct layer sequence and then, as described above, sealed to one another. The resulting row of foil bags is then cut along the weld seams into individual foil bags.

It must be guaranteed that the side foils are also interconnected in the area of the bottom foil to ensure a stable foil bag. To this end, corresponding recesses must be provided in the bottom foil so as to ensure that the side edges of the side foils are also interconnected in the area of the bottom foil.

Due to a malfunction it may easily happen that the recesses are defective, displaced or not produced at all. Since the bottom foil comes to rest between the two side foils and is thus not visible in the unfilled state of the foil bag, a visual inspection for checking wether the bottom foil comprises corresponding recesses can only be carried out under great efforts with the further processing operation being slowed down or interrupted.

SUMMARY OF THE INVENTION

It is the object of the present invention to provide a method and an apparatus for producing foil bags, wherein the manufacture of corresponding recesses is checked in a reliable manner.

During the supply operation, holes are at least punched into the bottom foil, the holes being spaced apart in the running direction of the bottom foil at a distance corresponding to the width of one foil bag. These holes are substantially arranged in symmetry with the center line of the bottom foil in the running direction. The bottom foil is folded along said center line. The punching operation and the folding operation can also be interchanged. During the supply operation a measuring operation is carried out after the punching operation for determining whether punched holes have been produced. The side foils and the folded bottom foil are placed one upon the other and are connected at the future side edges of the foil bag such that at the place where the bottom foil is positioned between the side foils the side edges are only directly interconnected by the punched holes. Finally, the connected foil sequence is cut such that the side-edge connecting area is respectively divided between two foil bags.

Hence, in the method according to the invention, it is already checked before the introduction of the bottom foil whether the punched holes have been provided at all and whether they have been introduced in the correct position and at the correct distance.

The optical measurement can be employed in the further course of the process, for example, for transmitting an acoustic or optical alarm signal to the operating personnel or for stopping the foil-bag producing device. Since the punched holes are already detected prior to the introduction of the bottom foil between the side foils, defective foil bags that would have to be sorted out at a later time are not produced. Thus, the method according to the invention enhances the reliability and avoids time losses caused by malfunctions.

In the method according to the invention the punching operation can be carried out prior to the folding operation for the bottom foil. For instance, the presence of punched holes can be checked individually and exactly for all punched holes that are arranged side by side in a direction perpendicular to the running direction of the bottom foil. However, it is just as well possible that the folding operation is carried out prior to the punching operation. The punching operation and the hole measuring operation can thus be carried out in an efficient manner and with a minimum number of punching and measuring means.

The foils can be adhesively bonded to one another along the future edges. However, sealed or welded edges are very simple and reliable.

The measurement as to whether the punched holes have been produced can e.g. be carried out with the help of corresponding contact sensors. An optical measurement, however, is advantageously provided for. An optical measurement guarantees a highly reliable contactless measuring operation.

Another advantageous development provides for proximity switches which can be used in the case of metal-containing foils and are less prone to soiling and moisture.

The punched holes are symmetrically arranged around the center line of the bottom foil at which the bottom foil is folded. A single punched hole may here be provided in a direction perpendicular to the running direction of the bottom foil, said single hole being folded at the same time when the bottom foil is folded. However, the reliability of the production process and the stability of the foil bag are enhanced when two respective punched holes are provided in a direction perpendicular to the running direction of the bottom foil, the holes being superimposed by the folding operation.

In an advantageous development of the method a measurement is carried out before the foils are connected to determine whether a bottom foil has been supplied at all. A malfunction of the supply mechanism of the bottom foil can thus be detected in an easy manner, and side foils can be prevented from being interconnected without a bottom foil being positioned thereinbetween. Moreover, a tom foil or the end of the foil can also be determined in this manner.

Finally, the sensor can also be used for detecting the time when a malfunction, such as a tom foil, occurs between the sensor and a processing station which is arranged downstream thereof. Such a malfunction is detected in that the signal state of the sensor does not change.

Advantageously, such a measurement is again carried out in an optical manner, which is made possible by contactless detection or with the help of a proximity switch. In a simple development of the method according to the invention, the hole measurement for detecting whether punched holes are present and the foil measurement for detecting whether a bottom foil has been supplied are carried out with the aid of a joint measurement device.

The method according to the invention can be carried out in a highly efficient manner when the two supplied side foils have each a width corresponding to that of the extension of a plurality of foil bags and when a corresponding number of bottom foils are supplied. It is thus possible to produce a plurality of foil bags side by side, and individual components, such as the connecting means or the cutting means for cutting the foils into individual bottom foils, need only be provided once.

The foil-bag producing apparatus of the invention for carrying out the method according to the invention comprises a punching means for punching holes into the bottom foil that are arranged in symmetry with the center line of the bottom foil, as well as a measuring means for detecting the punched holes. A second measuring means may advantageously be provided for detecting whether a bottom foil exists.

An advantageous embodiment comprises a light barrier as a measuring point. The signal of a light barrier can be read out in an easy manner and can be used for directly producing an alarm signal or for switching off the apparatus.

Another advantageous embodiment comprises a proximity switch as a measuring point. Such a proximity switch is less prone to soiling and moisture and can specifically be used in metal-containing foils.

DESCRIPTION OF THE DRAWINGS

An embodiment of the apparatus according to the invention will now be illustrated with reference to the enclosed figures, and the method according to the invention will be described.

DETAILED DESCRIPTION OF THE ILLUSTRATED EMBODIMENTS

Figure 4:
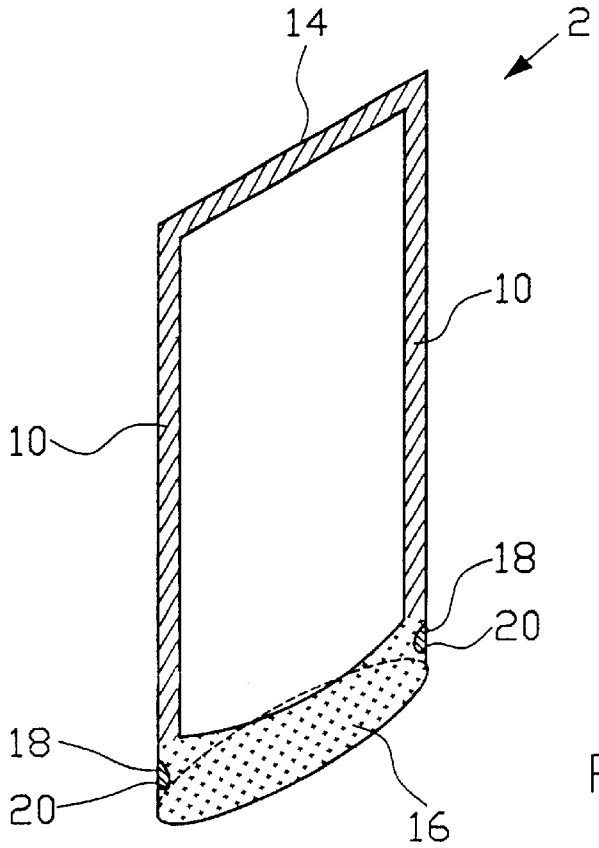
FIG. 4 is a perspective view of a finished foil bag.
Figure 5:
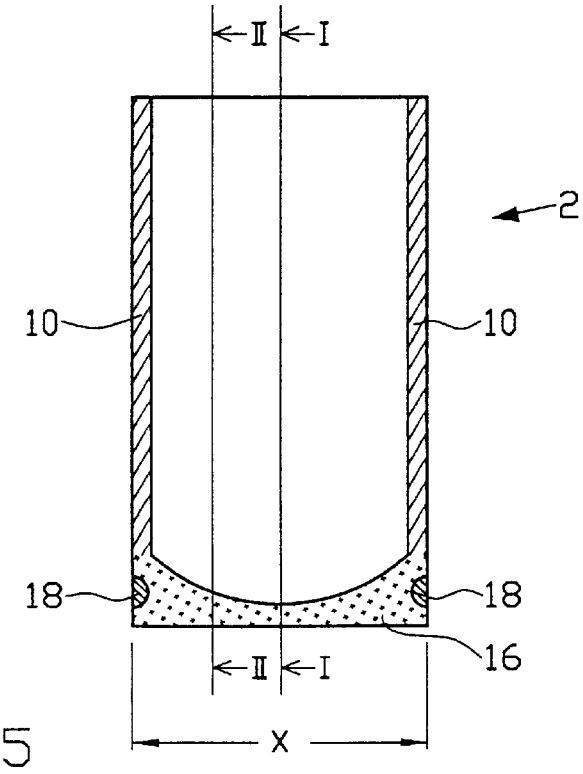
FIG. 5 is a side view of a finished foil bag.

FIG. 4 shows a finished foil bag. 10 designates weld seams which interconnect the side foils at the side edges (hatched portion). 16 designates the area in which the bottom foil is sealed to the side foils (represented by crosses). Punched portions 20 are provided in the bottom area in the bottom foil for sealing the side foils directly to each other, i.e. also in the bottom area. As a result, one obtains direct side foil/side foil seals or welds 18 in the bottom area. After the bag has been filled, the upper edge is closed by a further weld seam 14. FIG. 5 is a side view of a foil bag 2 that is still unfilled and unclosed. The width is designated by x. The material of the foils may e.g. be laminated aluminum foil. Insofar as weld seams or welds or seals are mentioned in the present description, these terms comprise directly welded or sealed portions of the respective foils, as well as bonds and hot bonding, respectively.

Figure 6A:
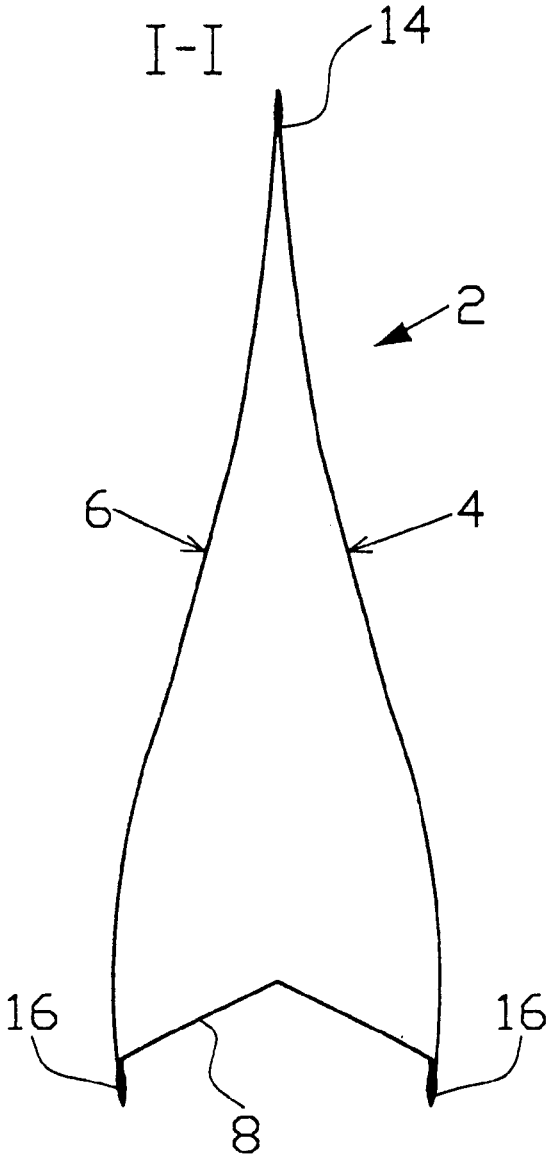
FIGS. 6*a* and 6*b* are sectional views of a foil bag along line I—I and II—II, respectively, of FIG. 5.
Figure 6B:
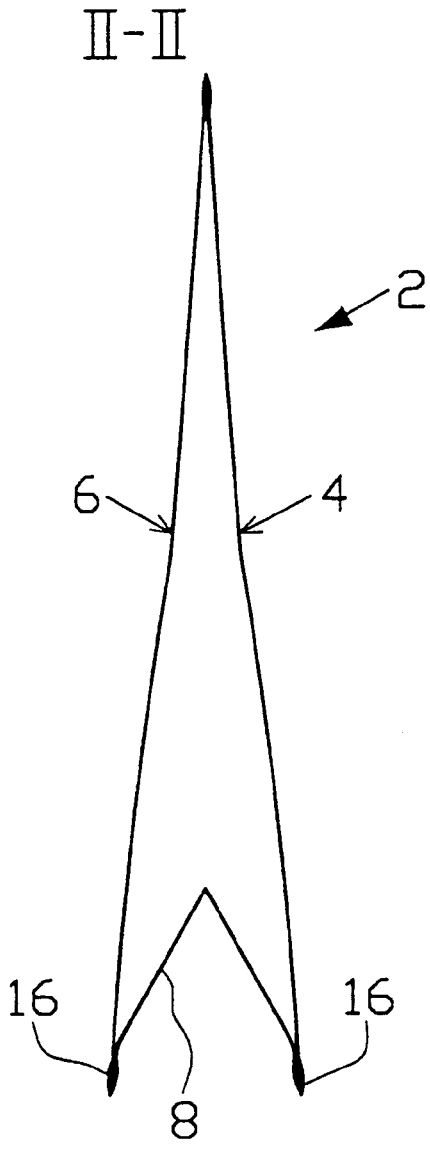

FIGS. 6*a* and 6*b* show the same foil bag after it has been filled and closed. The sections approximately correspond to lines I and II which are drawn into FIG. 5 for the unfilled foil bag. Approximately in the center of the foil bag, which is shown as a section in FIG. 6*a*, the bottom foil 8 is folded apart to a considerable extent, and there is space for the filling material between the side foils 6 and 4. Closer to the side edge of the foil bag, the bottom foil 8 is folded together to a greater degree and the space between the side foils 6 and 4 decreases with a decreasing distance from the side edge of the foil bag. Directly at the side edge, the side foils 4 and 6 are directly interconnected along the weld seam 10 and the side foil/side foil weld or seal 18, as shown in FIGS. 4 and 5. The stability of the foil bag and a reliable upright position are guaranteed by the side foil/side foil weld or seal 18.

Figure 1:
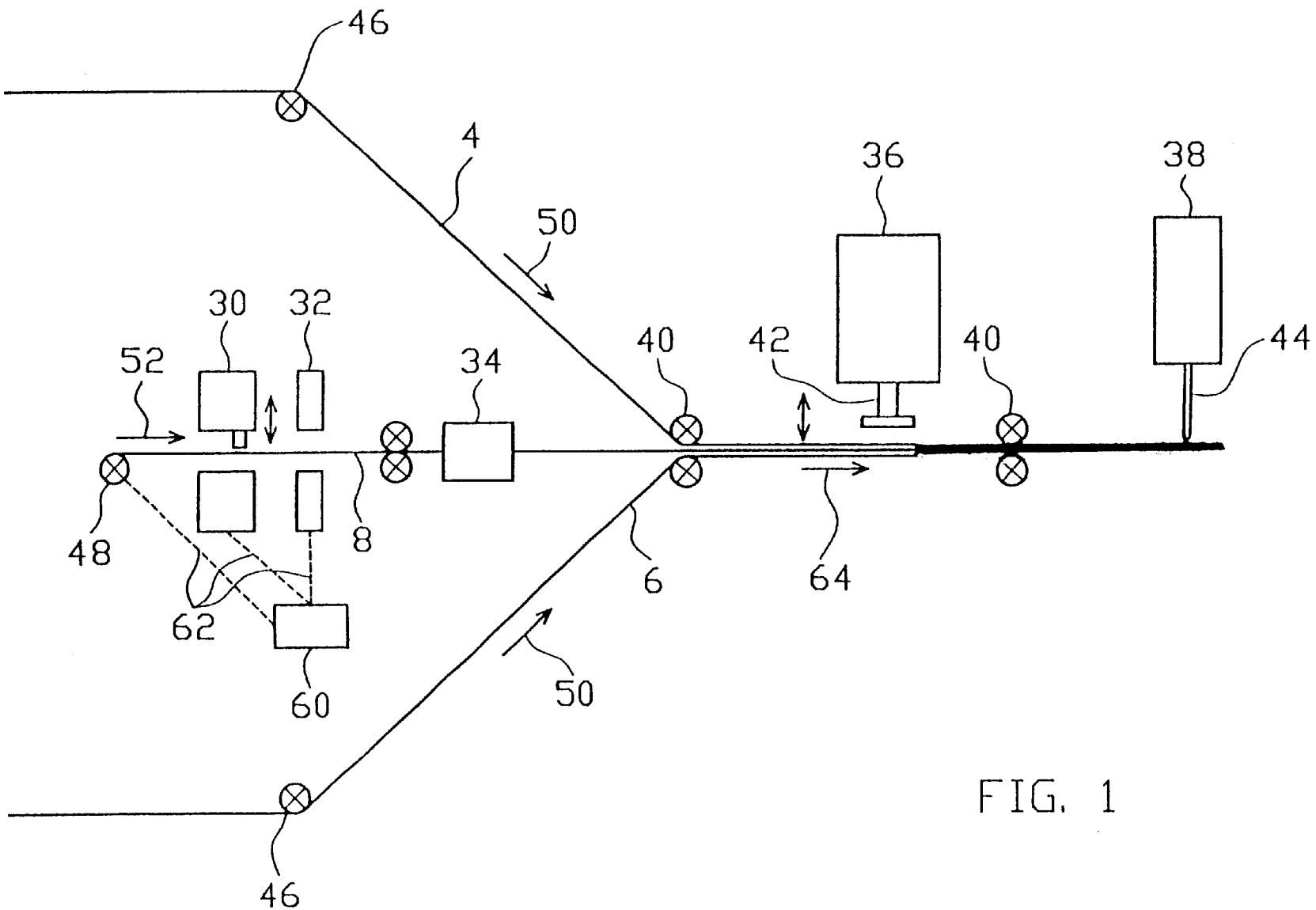
FIG. 1 is a schematic view of a foil-bag producing apparatus.

FIG. 1 is a schematic view showing an apparatus according to the invention. Side foils 4 and 6 are unwound from supply rolls, which are here of no further interest, and are supplied with the aid of deflection rolls 46 and supply rolls 40 to a sealing means 36 which includes a sealing head 42 that is movable upwards and downwards. The supply direction is designated by 50. Bottom foil 8 is withdrawn from a supply roll 48 and is moved by the feed rollers 40 in the supply direction 52. 30 designates a punching means and 32 an optical measuring means, e.g. light barriers which in their position perpendicular to the supply direction 52 correspond to the punching means 30. 34 designates a folding means which serves to fold the bottom foil along the running direction 52, the exact mode of operation being here of no importance. In another embodiment, the folding means 34 may be provided upstream of the punching means 30, so that the punching means punches through the already folded bottom foil. 38 designates a cutting means including a knife 44 which extends over the entire width of the foil material. 62 designates signal lines which connect the supply roll 48 for the bottom foil, the punching means 30 and the light barrier 32 to a control unit 60. 64 designates the transportation device of the folded foils.

Figure 2:
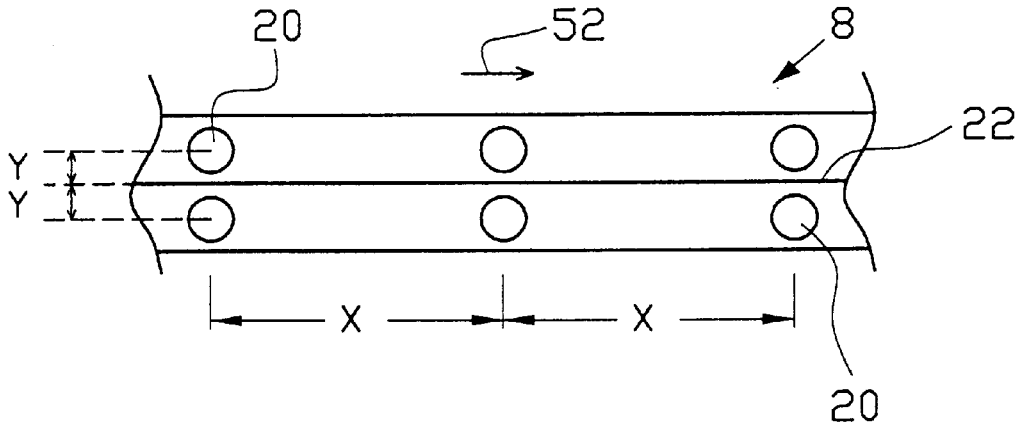
FIG. 2 shows a bottom foil prior to the sealing operation.

FIG. 2 shows the supplied bottom foil 8 after having passed through the punching means 30. At a distance x, which corresponds to the width of an unfilled foil bag, there are provided punched holes 20 whose distance from the center line 22 is y in each case. The dimensions y and x are a few millimeters and centimeters, respectively, depending on the dimensions of the finished foil bag 2.

Figure 3:
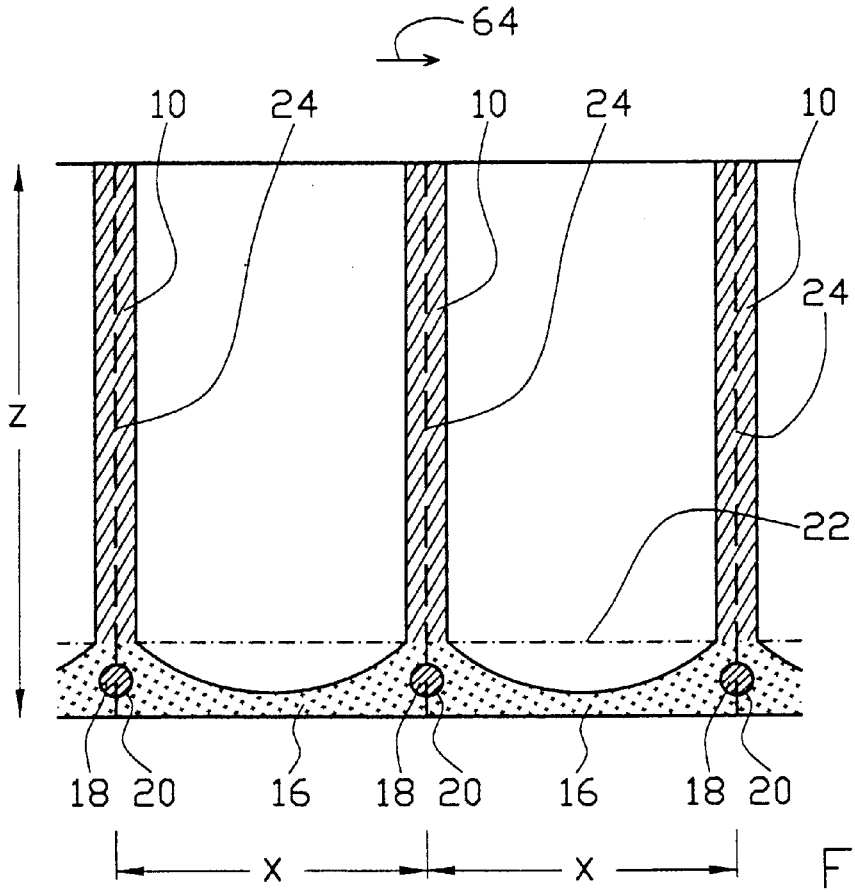
FIG. 3 shows sealed side and bottom foils prior to the cutting operation.

FIG. 3 shows a number of foil bags after having passed through the sealing means 36 and before passing through the cutting means 38 according to the arrangement of FIG. 1. The height of the foil bag in a direction perpendicular to the conveying direction 50 is designated by z. 24 designates the lines along which the row of foil bags are to be cut by the knife 44 of the cutting means 38. 22 designates the center line of the bottom foil 8 (see FIG. 2) which in this state after the sealing or welding operation represents a folding edge.

The method according to the invention is carried out with the described embodiment as follows: The supply means 40, which may e.g. be designed as rotating rolls, convey both the side foils 4, 6 and the bottom foil 8. The bottom foil 8 is here unwound from the supply roll 48 (see FIG. 1). Downstream of the supply roll 48, punched holes 20 are introduced into the bottom foil with the aid of the punching means 30, the punched holes being symmetrically arranged with respect to the center line. The bottom foil is then passed through light barriers 32 which are arranged in accordance with the position of the punched holes. Whenever a punched hole 20 passes through a light barrier 32, a corresponding electrical signal is produced and supplied via the signal line 62 to the control unit 60.

Moreover, the control unit 60 receives a signal about the speed of the supply roll 48 and the punching rate of the punching means 30. The control unit 60 calculates on the basis of the speed of the bottom foil and the punching rate at which distance the punched holes 20 are expected to arrive at the light barrier 32, and compares said calculated value with the signal from the light barriers 32.

In cases where a bottom foil is absent and consequently the light barriers 32 constantly produce a signal, and also in cases where punched holes 20 are absent and the light barriers 32 do consequently not produce any signals, there will be no identity between the calculated measurement signal and the measurement signal of the light barrier 32, and the control unit 60 will produce an alarm signal which can e.g. be used for stopping the entire apparatus. Likewise, the light barriers 32 will not transmit any signals in case of a malfunction, such as a torn foil, which is observed downstream of the punching and folding means. In such a case foil material will no longer be requested and the signal state will not change.

During normal operation, in the embodiment shown in the figures, the punched bottom foil 8 is folded in the folding means 34 along line 22 and introduced between the side foils 4 and 6. The sealing means 36 seals the side foils along the weld seams 10, as are shown in FIG. 3, in a manner which is known per se. The side foils 4, 6 are not directly sealed to each other in the bottom area 16, except for the areas 18 in which the punched holes of the bottom foil 8 are located. The side foils 4, 6 and the bottom foil 8 which are thus put together and sealed are transported further away in the direction 64 and are then cut along lines 24. The cutting edges 24 are positioned such that the weld seams 10 between two adjoining foil bags are divided and extend through the punched holes 20 of the bottom foil 8. It is thereby guaranteed that the side foils are sealed to each other also in the bottom area of the foil bag 2, directly by means of the punched holes 20.

The method according to the invention ensures that punched holes 20 really exist in the bottom foil. A further checking operation as to whether the side foils 4, 6 are also sealed to each other in the bottom area can thus be dispensed with. Such a time-consuming checking operation would prolong the manufacturing process of the foil bags in an undesired manner. Moreover, it is ensured in the illustrated embodiment that the bottom foil 8 is actually introduced between the side foils 4,6 and that there is no tom foil, which further enhances the reliability.

What is claimed is:

1. A method of producing foil bags, each foil bag having a width and corresponding side edges, the method comprising:

supplying first and second side foils from which a pair of side walls of the foil bag are formed;

supplying a bottom foil;

punching a plurality of holes into the bottom foil, said holes being spaced apart in a running direction of the bottom foil at a distance corresponding to the width of a foil bag;

folding the bottom foil along a center line substantially parallel to the running direction of the bottom foil, the holes being substantially symmetrical with respect to the center line;

simultaneously determining with a single sensor whether the bottom foil is moving, whether the holes have been produced in the bottom foil, and whether the bottom foil is present for assembly;

placing the first side foil, the folded bottom foil and the second side foil at least partially one upon the other in a layer sequence having that relative orientation;

connecting the layer sequence at the side edges of the foil bag in such a manner that at the place where the bottom foil is positioned between the side foils, the side edges are only directly connected to each other through the punched holes; and cutting the connected portions of the layer sequence such that a side-edge connection portion is respectively divided between two foil bags.

2. The method according to claim 1, wherein the connection step comprises a sealing or welding process.

3. The method according to claim 1, wherein the punching operation is carried out prior to the folding operation.

4. The method according to claim 1, wherein the folding operation is carried out prior to the punching operation.

5. The method according to claim 1, wherein the hole measurement is carried out optically for determining whether punched holes have been produced.

6. The method according to claim 1, wherein the hole measurement for determining whether punched holes have been produced is carried out with the aid of a proximity switch.

7. The method according to claim 1, wherein at least two punched holes are punched side by side in symmetry around the center line of the bottom foil.

8. The method according to claim 1, wherein the foil measurement is carried out optically.

9. The method according to claim 1, wherein the foil measurement is carried out with the aid of at least one proximity switch.

10. The method according to one of claims 5, 8 and 9, wherein at least one light barrier is used for the optical measurement.

11. The method according to claim 1, wherein the two supplied side foils have a width corresponding to the height of a plurality of foil bags, and a corresponding number of bottom foils are supplied.

12. An apparatus for producing a plurality of foil bags, each having side walls and a bottom, comprising:

first and second supply means for supplying foil material for the side walls of the foil bags;

at least one third supply means for supplying bottom foil material for the bottom of the foil bags;

a punching means for punching holes symmetrically arranged with respect to a center line of the bottom foil;

a folding means for folding the bottom foil;

a single measuring means configured to simultaneously detect whether the bottom foil is moving, whether the holes have been produced in the bottom foil, and whether the bottom foil is present;

a connecting means for connecting the side foils and the bottom foil; and a cutting means for cutting apart the foil bags.

13. The apparatus according to claim 12, wherein the connecting means comprises a sealing means.

14. The apparatus according to claim 12, wherein the measuring means comprises an optical measuring means.

15. The apparatus according to claim 12, wherein the measuring means comprises a proximity switch.

16. The apparatus according to claim 14, wherein the optical measuring means comprises a light barrier.

17. The apparatus according to claim 12, wherein the measuring means comprises a joint measuring point.

18. The apparatus according to claim 12, further comprising a plurality of punching means arranged side by side in a direction perpendicular to the running direction of the bottom foil, and a corresponding number of measuring means are arranged side by side in a direction perpendicular to the running direction of the bottom foil.

19. The apparatus according to claim 12, wherein the folding means is arranged upstream of the punching means.

20. The apparatus according to claim 12, wherein the folding means is arranged downstream of the punching means.

21. A method of producing foil bags, each foil bag having a width and corresponding side edges, the method comprising:

supplying side foils from which a pair of walls of the foil bag are formed;

supplying a bottom foil having a plurality of holes therein corresponding to the width of the foil bag;

directing the bottom foil past a single sensor configured to generate a first signal when a foil is present and a second, distinct signal when a hole or no foil is present, an alternating signal from the sensor indicating that the bottom foil is present and moving, and that the holes have been produced in the bottom foil;

generating an error signal when the sensor has not generated the alternating signal after a predetermined minimum duration;

placing the bottom foil at least partially between the side foils in a layer sequence;

connecting the layer sequence at the side edges of the foil bag; and cutting the connected portions of the layer sequence such that a side-edge connection portion is respectively divided between two foil bags.

* * * * *